US012557895B2

(12) United States Patent
Chung et al.

(10) Patent No.: US 12,557,895 B2
(45) Date of Patent: Feb. 24, 2026

(54) SLIDE-TYPE COSMETIC COMPACT CASE

(71) Applicant: CTK COSMETICS CO., LTD., Seoul (KR)

(72) Inventors: In Yong Chung, Seoul (KR); Won Geun Go, Incheon (KR); Jae Hui Lee, Suwon-si (KR)

(73) Assignee: CTK COSMETICS CO., LTD., Seoul (KR)

( * ) Notice: Subject to any disclaimer, the term of this patent is extended or adjusted under 35 U.S.C. 154(b) by 1080 days.

(21) Appl. No.: 17/434,633

(22) PCT Filed: Aug. 23, 2019

(86) PCT No.: PCT/KR2019/010763
§ 371 (c)(1),
(2) Date: Mar. 17, 2022

(87) PCT Pub. No.: WO2020/184793
PCT Pub. Date: Sep. 17, 2020

(65) Prior Publication Data

US 2025/0040681 A1 Feb. 6, 2025

(30) Foreign Application Priority Data

Mar. 8, 2019 (KR) ..... 10-2019-0027028

(51) Int. Cl.
*A45D 33/00* (2006.01)
*A45D 33/36* (2006.01)

(52) U.S. Cl.
CPC ..... *A45D 33/008* (2013.01); *A45D 33/36* (2013.01)

(58) Field of Classification Search
CPC ..... A45D 40/24; A45D 40/22; A45D 33/008; A45D 33/006; A45D 33/20; A45D 33/218;

(Continued)

(56) References Cited

U.S. PATENT DOCUMENTS 5,638,839 A * 6/1997 Montoli ..... A45D 40/22 220/255
5,836,319 A * 11/1998 Lombardi ..... A45D 33/008 132/294

(Continued)

FOREIGN PATENT DOCUMENTS

FR 2600240 A3 * 12/1987
KR 20-0227220 Y1 6/2001

(Continued)

OTHER PUBLICATIONS

KR1020160028553_Shin_publication date Mar. 14, 2016 (Year: 2016).*

(Continued)

*Primary Examiner* — Thomas C Barrett
*Assistant Examiner* — Sarah Woodhouse
(74) *Attorney, Agent, or Firm* — Bridgeway IP Law Group, PLLC; Jihun Kim

(57) ABSTRACT

Proposed is a portable slide-type cosmetic compact case including: a case body including an upper plate, which has a cosmetic product accommodation part in which cosmetics are accommodated, a lower plate spaced from the upper plate so as to face same, and a side peripheral wall connecting the upper plate and the lower plate and having an open portion, wherein the upper plate, the lower plate and the open side peripheral wall form a slide storage part; a brush unit which is a brush, that is used while the cosmetic product is applied thereon, and which slides in the slide storage part through the open portion in the side peripheral wall so as to be inserted therein and attached/detached thereto/therefrom; and a cover which covers the cosmetic product accommodation part from the upper side of the upper plate and which is coupled to the case body.

5 Claims, 7 Drawing Sheets

(58) Field of Classification Search
CPC ..... A45D 33/18; A45D 33/22; A45D 33/24; A45D 33/26; A45D 33/36
See application file for complete search history.

(56) References Cited

U.S. PATENT DOCUMENTS 6,298,863 B1 * 10/2001 Byun ..... A45D 40/22 132/294
7,140,372 B2 * 11/2006 Byun ..... A45D 40/22 132/297
2004/0129599 A1 * 7/2004 Yi-Hung ..... A45D 33/20 206/581
2004/0173234 A1 * 9/2004 Byun ..... A45D 40/222 132/287
2004/0221866 A1 * 11/2004 Greenfield ..... A45D 40/222 132/287
2010/0319724 A1 * 12/2010 Chung ..... A45D 40/24 132/295
2013/0014778 A1 * 1/2013 Zhang ..... A45D 33/008 132/316
2013/0092691 A1 * 4/2013 Sato ..... A45D 33/20 220/288
2020/0163433 A1 * 5/2020 Sanchez Casadevall ..... A45D 33/34

FOREIGN PATENT DOCUMENTS

KR 10-0479410 B1 3/2005
KR 10-1439533 B1 9/2014
KR 10-1918481 B1 11/2018

OTHER PUBLICATIONS

FR2877818A1_Grandmottet_publication date May 19, 2006 (Year: 2006).*

* cited by examiner

SLIDE-TYPE COSMETIC COMPACT CASE

TECHNICAL FIELD

The present invention relates to a slide type cosmetic compact case, and more particularly, to a slide type cosmetic compact case that is configured to have the shape of a disc and to provide a slide type coupling structure, thereby being compact in size and used conveniently.

BACKGROUND ART

Cosmetics are all of the products that are intended to make a user's appearance beautiful as well as to clean his or her body or nourish his or her skin and hair, thereby improving his or her appearance and health.

Cosmetics are classified into cleansing cosmetics for removing blackhead, waste and pollutants from the surface of the skin, skin care cosmetics for appropriately supplying water and oil to the skin, makeup cosmetics for expressing the face with colors, hair care products for removing dead skin from the hair or scalp and protecting and nourishing the hair, and perfume products made by melting fragrances by alcohol to emit the fragrances to other persons.

In addition to such classification of cosmetics, however, as to whether cosmetics are in the form of liquid, solid, or powder is the most important factor in determining the shapes of cosmetic containers, and according to the application methods of cosmetics, next, the cosmetic containers are made with various designs.

Generally, cosmetic compacts are configured to accommodate a powder type cosmetic substance in a case, and accordingly, the powder type cosmetic substance is sucked to a puff made of a sponge material and then applied to his or her skin.

However, a conventional cosmetic compact case has a limitation in compactness thereof if a cosmetic substance accommodation part and a puff made of a urethane or sponge material are accommodated therein, and further, if the cosmetic compact case is put in a user's bag or the like and carried around, the bag may be deformed in shape, thereby having many difficulties in handling the cosmetic compact case.

Because of the design for minimizing the thickness and volume of the cosmetic compact case, further, a brush or mirror required for makeup may not be built in the cosmetic compact case. As the brush or mirror necessarily needed to do makeup or makeup correction is not built in the cosmetic compact case, accordingly, the brush or mirror has to be additionally purchased and carried inconveniently around.

In specific, a general cosmetic compact case that is open and closed by up and down rotation is open with a user's both hands, thereby causing many inconveniences in use.

Accordingly, there is a need to develop a cosmetic compact case capable of being compact in size and convenient in use, while having a brush or mirror built therein.

DISCLOSURE

Technical Problem

Accordingly, the present invention has been made in view of the above-mentioned problems occurring in the related art, and it is an object of the present invention to provide a slide type cosmetic compact case that is capable of being compact in size and conveniently used, while a brush or mirror is being built therein.

The technical problems to be achieved through the present invention are not limited as mentioned above, and other technical problems not mentioned herein will be obviously understood by one of ordinary skill in the art through the following description.

Technical Solution

To accomplish the above-mentioned objects, according to the present invention, there is provided a portable slide type cosmetic compact case in which a cosmetic product is placed. According to the present invention, the slide type cosmetic compact case may include: a case body having an upper plate with a cosmetic product accommodation part adapted to accommodate the cosmetic product therein, a lower plate facingly spaced apart from the upper plate, and a side peripheral wall for connecting the upper plate and the lower plate to each other and having a portion open thereon, the upper plate, the lower plate, and the side peripheral wall constituting a slide storage part; a brush unit serving as a brush to which the cosmetic product is applied and slidingly inserted and drawn into and from the slide storage part through the open portion of the side peripheral wall; and a cover coupled to the case body and covering the cosmetic product accommodation part on top of the upper plate.

According to the present invention, the cover may include: a cover plate facing the upper plate; a side peripheral surface extended downwardly from the periphery of the cover plate to cover the side peripheral wall of the case body; a hinge coupling part protruding downwardly from one side end of the side peripheral surface to be hinge-coupled to the case body; and a locking part protruding downwardly from the other side end of the side peripheral surface opposite to the hinge coupling part and covering the brush unit inserted into the slide storage part from outer side thereof to cover the brush unit exposed through the open portion.

According to the present invention, the case body may further include: a peripheral portion protruding upwardly from the top periphery of the upper plate to constitute the cosmetic product accommodation part together with the upper plate; a hinge coupling groove formed on the side peripheral wall such that the hinge coupling part of the cover is insertedly hinge-coupled thereto; and a guide groove formed on the periphery of the upper plate such that the locking part is press-fitted thereto.

According to the present invention, the brush unit may include: a handle part whose outer surface is covered with the locking part when the brush unit is inserted into the slide storage part; and a brush part coupled to the handle part and accommodated in the slide storage part.

According to the present invention, the handle part has a coupling groove formed concavely on the outer peripheral surface thereof toward the slide storage part, and the locking part of the cover is inserted into the coupling groove of the handle part from top thereof.

According to the present invention, the coupling groove of the handle part has a bottom surface located toward the slide storage part and a locking slot formed on the bottom surface, and the locking part of the cover has a protrusion locked onto the locking slot.

According to the present invention, the handle part may include an internal space portion facing the slide storage part and a through hole formed on top thereof toward the internal space portion, and the brush part may include: a guide block inserted into the internal space portion of the handle part, a portion of the guide block being exposed to the outside through the through hole so that the guide block is pushed toward the slide storage part or pulled toward the opposite side to the slide storage part; and a brush coupled to the guide block and accommodated in the slide storage part.

According to the present invention, the brush unit may include: a handle part whose outer surface is covered with the locking part when the brush unit is inserted into the slide storage part; and a brush part coupled to the handle part and accommodated in the slide storage part, the handle part has a coupling groove formed concavely on the outer peripheral surface thereof toward the slide storage part at the corresponding position to the guide groove of the case body, and the locking part of the cover is inserted through the guide groove of the case body into the coupling groove of the handle part from top thereof.

According to the present invention, the slide type cosmetic compact case may further include a cosmetic product container open on top thereof to contain the cosmetic product therein and detachably inserted into the cosmetic product accommodation part.

According to the present invention, the slide type cosmetic compact case may further include a mirror attached to the cover plate of the cover to face the upper plate.

Advantageous Effects

According to the present invention, the slide type cosmetic compact case is provided with the case body that has the cosmetic product accommodation part and the slide storage part into which the brush unit is slidingly stored, so that the cosmetic compact case can be compact in size and used conveniently, while the brush or mirror is being built therein.

The effects of the invention are not limited as mentioned above, and it should be understood that the effects of the invention include all effects inferable from the detailed description and claims of the present invention.

MODE FOR INVENTION

Figure 1:
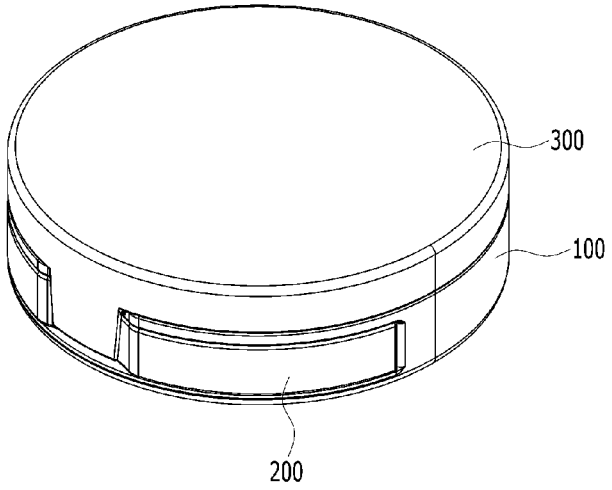
FIG. 1 is a perspective view showing a slide type cosmetic compact case according to an embodiment of the present invention.

Hereinafter, the present invention will be in detail explained with reference to the attached drawings. However, the present invention may be modified in various ways and may have several exemplary embodiments. Therefore, the present invention is not limited with the embodiments as will be explained herein. In order to clearly describe the present invention, through the accompanying drawings, parts having no relation with the explanation are not illustrated, and in the description, the same reference numerals will be used to describe the same components.

In the description, when it is said that one element is described as being "connected" (contacted or coupled) to the other element, one element may be directly connected or coupled to the other element, but it should be understood that another element may be present between the two elements. When it is said that one portion is described as "includes" any component, further, one element may further include other components unless no specific description is suggested.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or 'have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

Now, embodiments of the present invention will be explained in detail with reference to the attached drawings.

Figure 2:
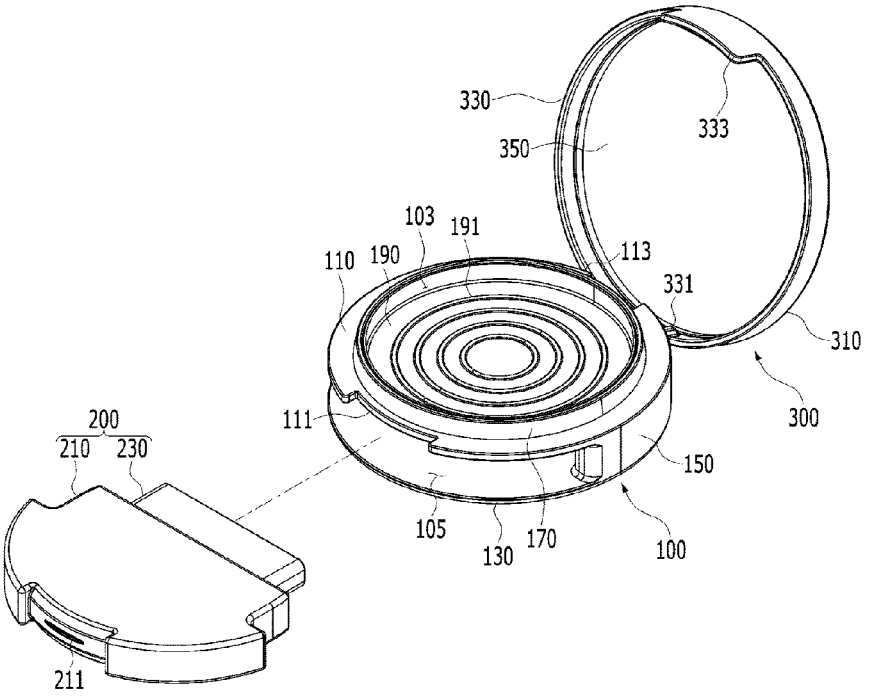
FIG. 2 is a perspective view showing the state where the slide type cosmetic compact case of FIG. 1 is used.

FIG. 1 is a perspective view showing a slide type cosmetic compact case according to an embodiment of the present invention. FIG. 2 is a perspective view showing the state where the slide type cosmetic compact case of FIG. 1 is used.

A slide type cosmetic compact case according to the present invention can be applied to a portable cosmetic compact case in which a cosmetic product is placed.

The slide type cosmetic compact case according to the present invention includes a case body 100, a brush unit 200, and a cover 300.

The case body 100 includes an upper plate 110 having a cosmetic product accommodation part 103 adapted to accommodate a cosmetic product therein, a lower plate 130 facingly spaced apart from the upper plate 110, and a peripheral wall 150 for connecting the upper plate 110 and the lower plate 130 to each other and having a portion open.

In this case, the upper plate 110, the lower plate 130, and the side peripheral wall 150 whose portion is open constitute a slide storage part 105.

The brush unit 200 serves as a brush to which the cosmetic product is applied. The brush unit 200 is slidingly inserted and drawn into and from the slide storage part 105 through the open portion of the side peripheral wall 150.

The cover 300 is coupled to the case body 100 to cover the cosmetic product accommodation part 103 on top of the upper plate 110. The cosmetic product accommodation part 103 will be explained later.

The brush unit 200 includes a handle part 210 and a brush part 230.

The brush unit 200 is inserted and drawn into and from the slide storage part 105 of the case body 100.

The brush part 230 is coupled to the handle part 210 and is accommodated in the slide storage part 105. When the brush unit 200 is inserted into the slide storage part 105, the outer peripheral surface of the handle part 210 is covered with the cover 300.

The cover 300 is coupled to the case body 100 on top of the case body 100 and covers a portion of the outer peripheral surface of the brush unit 200 accommodated in the slide storage part 105.

In a state where the brush unit 200 is inserted into the slide storage part 105, the cover 300 is covered on top of the case body 100, so that the slide type cosmetic compact case as shown in FIG. 1 can be provided. After that, if the cover 300 is open to pull a portion of the brush unit 200 exposed to the outside from the slide storage part 105, the brush part 230 can be used, as shown in FIG. 2.

Figure 3:
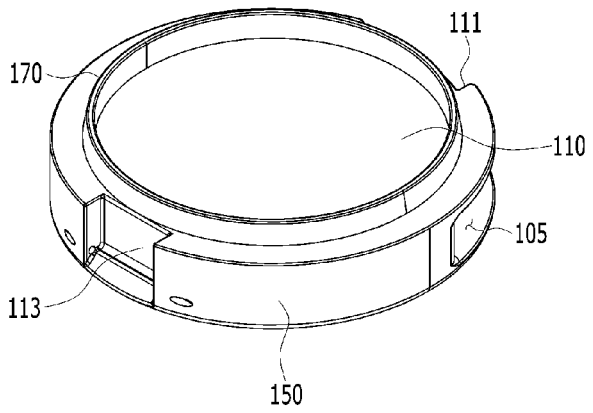
FIG. 3 is a perspective view showing a case body and a cosmetic product accommodation part of the slide type cosmetic compact case of FIG. 2.
Figure 3:
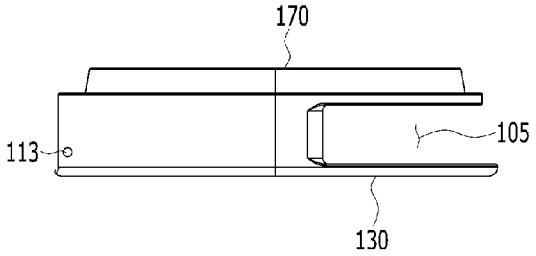

FIG. 3 is a perspective view showing the case body 100 of the slide type cosmetic compact case according to the present invention.

The case body 100 further includes a peripheral portion 170 protruding upwardly from the top periphery of the upper plate 110 to constitute the cosmetic product accommodation part 103 together with the upper plate 110.

The side peripheral wall 150 of the case body 100 has a hinge coupling groove 113 adapted to coupledly insert a hinge coupling part 331 (See FIG. 4) of the cover 300 thereinto, and the upper plate 110 of the case body 100 has a guide groove 111 formed on the opposite side periphery to the hinge coupling part 331.

The cover 300 is coupled to the case body 100 along the guide groove 111.

As shown on the lower side of FIG. 3, the hinge coupling groove 113 has fastening holes formed thereon and thus coupled to the cover 300.

The side peripheral wall 150 of the case body 100 is open on a portion thereof, and accordingly, the upper plate 110, the lower plate 130, and the side peripheral wall 150 constitute the slide storage part 105, so that the brush unit 200 can be slidingly inserted into the slide storage part 105.

The case body 100 has the shape of a general disc, and the outer peripheral surface of the handle part 210 fills the open portion of the side peripheral wall 150 of the case body 100, while being smoothly connected to the disc-shaped side peripheral wall 150.

Figure 4:
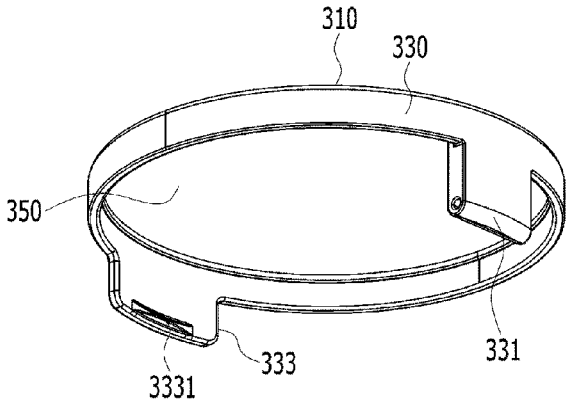
FIG. 4 is a perspective view showing the case body of the slide type cosmetic compact case according to the present invention.

FIG. 4 is a perspective view showing the cover 300 of the slide type cosmetic compact case of FIG. 2.

The cover 300 includes a cover plate 310 facing the upper plate 110 of the case body 100, a side peripheral surface 330, the hinge coupling part 331, and a locking part 333.

The hinge coupling part 331 protrudes downwardly from one side end of the side peripheral surface 330 and is thus coupled to the case body 100.

The locking part 333 protrudes downwardly from the other side end of the side peripheral surface 330 opposite to the hinge coupling part 331 and covers the outer peripheral surface of the brush unit 200 inserted into the slide storage part 105 from outer side thereof.

The handle part 210 has a coupling groove 211 formed concavely on the outer peripheral surface thereof toward the slide storage part 105 at a position corresponding to the guide groove 111 of the case body 100.

The locking part 333 of the cover 300 is inserted through the guide groove 111 of the case body 100 into the coupling groove 211 of the handle part 210 from top thereof.

When viewed from the outside, the coupling groove 211 of the handle part 210 includes a bottom surface located toward the slide storage part 105 and a locking slot formed on the bottom surface.

The locking part 333 of the cover 300 has a protrusion 3331 locked onto the locking slot of the handle part 210.

Accordingly, the cover 300 can be open and closed in a state of being rototably coupled to the case body 100 by means of the hinge coupling part 331, and the locking part 333 of the cover 300 is inserted into the guide groove 111 of the case body 100 and the coupling groove 211 of the handle part 210 of the brush unit 200, so that the cover 300 can be in a closed state.

So as to open the cover 300, contrarily, the locking part 333 of the cover 300 is slightly pressurized outwardly by a user's finger, and accordingly, the cover 300 becomes open elastically.

As another example of the locking slot formed on the coupling groove 211 of the brush unit 200, the coupling groove 211 of the brush unit 200 may have a bottom surface located toward the slide storage part 105 and angled at corners thereof, so that the locking part 333 of the cover 300 may have a protrusion locked onto the angled corners of the bottom surface of the coupling groove 211.

According to the present invention, the slide type cosmetic compact case further includes a mirror 350 attached to the cover plate 310 of the cover 300 to face the upper plate 110 of the case body 100.

Figure 5:
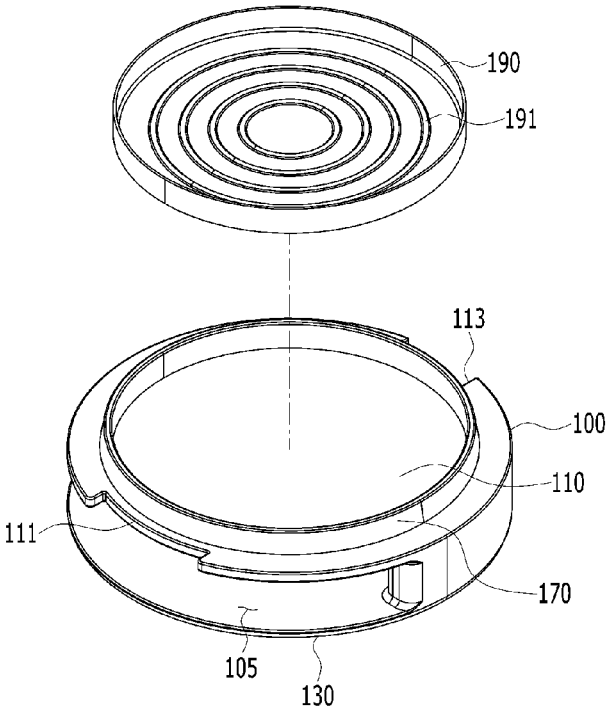
FIG. 5 is a perspective view showing a cover of the slide type cosmetic compact case of FIG. 2.

FIG. 5 is a perspective view showing the case body 100 and a cosmetic product container 190 of the slide type cosmetic compact case of FIG. 2.

As mentioned above, the case body 100 includes the peripheral portion 170 protruding upwardly from the top periphery of the upper plate 110, and accordingly, the upper plate 110 and the peripheral portion 170 constitute the cosmetic product accommodation part 103 for accommodating the cosmetic product.

The cosmetic product may be stored directly in the cosmetic product accommodation part 103, but as shown in FIG. 5, the cosmetic product container 190 or palette as a kind of container containing the cosmetic product is detachably inserted into the cosmetic product accommodation part 103.

The cosmetic product container 190 has a concentric or spiral protrusion 191 formed on the bottom thereof. If a sponge-like material is impregnated with the cosmetic product contained in the cosmetic product container 190, the protrusion 191 prevents the sponge-like material from being attached to the bottom of the cosmetic product container 190.

According to the present invention, the cosmetic product is accommodated in the cosmetic product accommodation part 103, and the brush unit 200 is in the slide storage part 105. Further, the mirror 350 is disposed on the cover 300, and the brush unit 200 is detachably mounted slidingly onto the slide storage part 105. In addition, the cover 300 can be easily open and closed.

Accordingly, the slide type cosmetic compact case according to the present invention can be compact in size and convenient in use.

Figure 6:
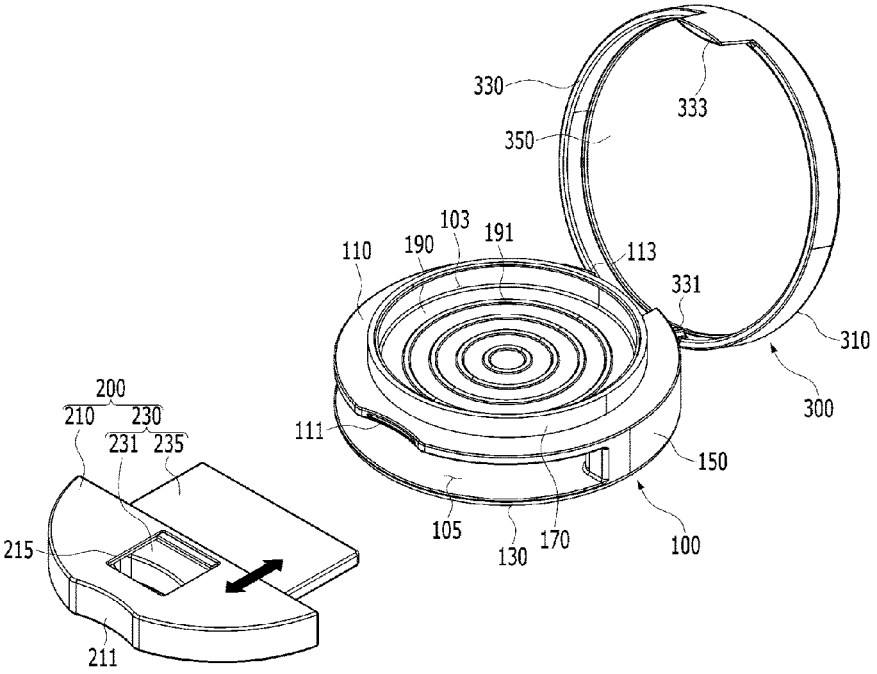
FIG. 6 is a perspective view showing a slide type cosmetic compact case according to another embodiment of the present invention.
Figure 7:
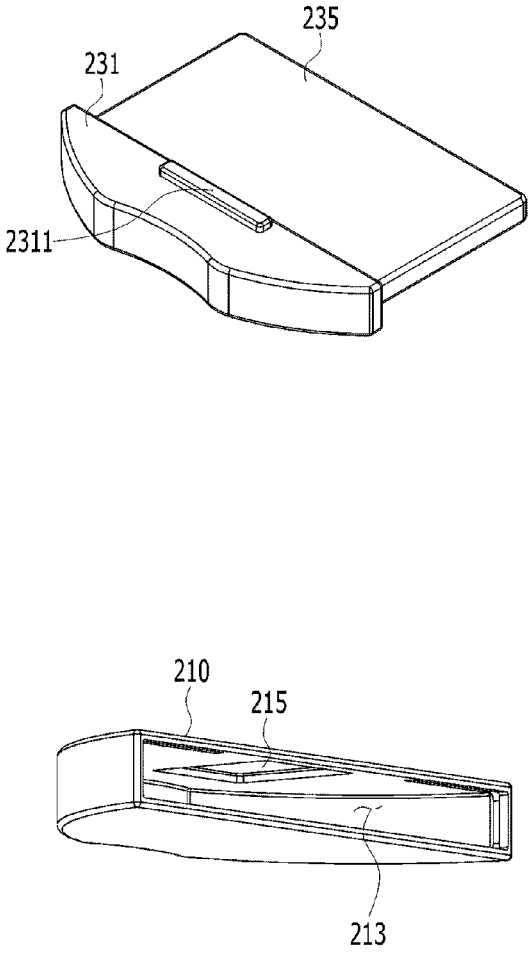
FIG. 7 is a perspective view showing a brush unit of the slide type cosmetic compact case of FIG. 6.

FIG. 6 is a perspective view showing a slide type cosmetic compact case according to another embodiment of the present invention. FIG. 7 is a perspective view showing a brush unit of the slide type cosmetic compact case of FIG. 6.

The configuration of the slide type cosmetic compact case according to another embodiment of the present invention excepting a brush unit 200 is similar to that of the slide type cosmetic compact as shown in FIGS. 1 to 5, and accordingly, repeated explanations will be avoided.

As shown in FIG. 6, the brush unit 200 includes a handle part 210 and a brush part 230. The handle part 210 is a plastic part and has an internal space portion 213 facing the slide storage part 105 and a through hole 215 formed on top thereof toward the internal space portion 213.

The brush part 230 includes a guide block 231 and a brush 235.

The guide block 231 is inserted into the internal space portion 213 of the handle part 210, and a portion 2311 protruding upwardly from the guide block 231 is exposed to the outside from the through hole 215 of the handle part 210, so that the guide block 231 is pushed toward the slide storage part 105 or pulled toward the opposite side to the slide storage part 105.

The brush 235 is coupled to the guide block 231 and accommodated in the slide storage part 105.

Accordingly, the length of the brush 235 can be adjusted according to the user's preference.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. For example, the parts expressed in a singular form may be dispersedly provided, and in the same manner as above, the parts dispersed may be combined with each other.

The present invention may be modified in various ways and may have several exemplary embodiments. Specific exemplary embodiments of the present invention are illustrated in the drawings and described in detail in the detailed description. However, this does not limit the invention within specific embodiments and it should be understood that the invention covers all the modifications, equivalents, and replacements within the idea and technical scope of the invention.

The invention claimed is:

1. A portable slide type cosmetic compact case in which a cosmetic product is placed, the portable slide type cosmetic compact case comprising:

a case body having:

an upper plate having a cosmetic product accommodation part adapted to accommodate the cosmetic product therein, a lower plate spaced apart from the upper plate and facing the upper plate, and a side peripheral wall connecting the upper plate and the lower plate to each other and having an open portion thereon, the upper plate, the lower plate, and the side peripheral wall constituting a slide storage part;

a brush unit configured to apply the cosmetic product and to be slidingly inserted and drawn into and from the slide storage part through the open portion of the side peripheral wall; and a cover coupled to the case body and configured to cover the cosmetic product accommodation part on top of the upper plate, wherein the cover comprises:

a cover plate configured to face the upper plate;

a side peripheral surface extending downwardly from a periphery of the cover plate;

a hinge coupling part protruding downwardly from one side end of the side peripheral surface to be hinge-coupled to the case body; and a locking part protruding downwardly from another side end of the side peripheral surface opposite to the hinge coupling part, the locking part being configured to cover the brush unit inserted into the slide storage part from an outer side thereof to cover the brush unit exposed through the open portion, wherein the case body further comprises:

a peripheral portion protruding upwardly from a top periphery of the upper plate, the peripheral portion and the upper plate together defining the cosmetic product accommodation part;

a hinge coupling groove defined on the side peripheral wall such that the hinge coupling part of the cover is inserted and hinge-coupled thereto; and a guide groove defined on a periphery of the upper plate such that the locking part is fitted-coupled thereto, wherein the brush unit comprises:

a handle part having an outer surface configured to be covered with the locking part when the brush unit is inserted into the slide storage part; and a brush part coupled to the handle part and configured to be accommodated in the slide storage part, wherein the handle part has a coupling groove defined concavely on an outer peripheral surface thereof toward the slide storage part, and the locking part of the cover is configured to be inserted into the coupling groove of the handle part from a top thereof, wherein a surface of the coupling groove of the handle part is configured to face the slide storage part when the brush unit is inserted into the slide storage part, a locking slot is defined on the surface of the coupling groove, and the locking part of the cover has a protrusion configured to be locked onto the locking slot, wherein the locking part of the cover is configured to be inserted into the guide groove of the case body and the coupling groove of the handle part of the brush unit, such that a distal end of the locking part is configured to be in contact with the lower plate of the case body while being disposed in the coupling groove of the handle part in a closed state of the cover, wherein the handle part comprises:

an internal space portion configured to face the slide storage part; and a through hole defined on a top surface of the handle part toward the internal space portion, and wherein the brush part comprises:

a guide block inserted into the internal space portion of the handle part, a portion of the guide block being exposed to an outside through the through hole of the handle part to guide the guide block toward the slide storage part or toward a side opposite to the slide storage part, wherein the guide block has a groove defined concavely on a side wall of the guide block, the groove of the guide block having a shape corresponding to a shape of the coupling groove of the handle part, wherein the surface of the coupling groove of the handle part extends from the top surface of the handle part to a bottom surface of the handle part, the surface of the coupling groove being perpendicular to the top surface and the bottom surface of the handle part.

2. The portable slide type cosmetic compact case according to claim 1, wherein a brush is coupled to the guide block and configured to be accommodated in the slide storage part.

3. The portable slide type cosmetic compact case according to claim 1, wherein the coupling groove is defined concavely on the outer peripheral surface of the handle part toward the slide storage part at a position corresponding to the guide groove of the case body, and wherein the locking part of the cover is configured to be inserted through the guide groove of the case body into the coupling groove of the handle part from the top thereof.

4. The portable slide type cosmetic compact case according to claim 1, further comprising:

a cosmetic product container open on top thereof to contain the cosmetic product therein and detachably inserted into the cosmetic product accommodation part.

5. The portable slide type cosmetic compact case according to claim 1, further comprising:

a mirror attached to the cover plate of the cover to face the upper plate.

* * * * *